US005377737A

United States Patent [19]

Moriya et al.

[11] Patent Number: 5,377,737

[45] Date of Patent: Jan. 3, 1995

[54] SCREEN RETRACTOR MECHANISM

[75] Inventors: Mamoru Moriya; Mitsuhiko Chino, both of Tokyo, Japan

[73] Assignee: Seiki Hanbai Co., Ltd., Tokyo, Japan

[21] Appl. No.: 78,823

[22] Filed: Jun. 21, 1993

[30] Foreign Application Priority Data

Dec. 17, 1992 [JP] Japan ..... 4-091697[U]
Jan. 25, 1993 [JP] Japan ..... 5-005110[U]

[51] Int. Cl.[6] ..... E06B 3/94
[52] U.S. Cl. ..... 160/84.06; 160/190
[58] Field of Search ..... 160/84.1 E, 84.1 D, 160/84.1 C, 84.1 R, 104, 107, 190, 193, 370.2 B, 4

[56] References Cited

U.S. PATENT DOCUMENTS 4,647,488 3/1987 Schnebly et al. ..... 160/84.1 E X
4,858,668 8/1989 Toti ..... 160/84.1 C
4,862,941 9/1989 Colson ..... 160/84.1 D
5,195,569 3/1993 Peterson et al. ..... 160/84.1 E

FOREIGN PATENT DOCUMENTS 53591 1/1993 Japan .

*Primary Examiner*—David M. Purol
*Attorney, Agent, or Firm*—Oblon, Spivak, McClelland, Maier & Neustadt

[57] ABSTRACT

A base end of the foldably stretchable accordion screen 10 is fixed to an inner portion of the receptacle box frame 13 which constitutes one of the side frame members of a screen support frame structure, and the movable frame is attached to the fore end of the screen slidably along the screen support frame for opening and closing the screen toward and away from the receptacle frame. Fixed to the movable frame 18 are the ends of a plural number of tension cords 20*a* to 20*d* which are folded around turn-guide members 21*b* to 21*d* and 22 on the side frame member. A pendant weight 24 is attached to the other ends of the tension cords which are hung down in the side frame member, thereby to apply to the movable frame a biasing force in the screen opening direction. The pendant weight 24 is associated width a resistant mechanism 26 which serves to buffer the descending motion of the pendant weight as it reaches its lower stop position.

11 Claims, 6 Drawing Sheets

SCREEN RETRACTOR MECHANISM

BACKGROUND OF THE INVENTION

Field of the Art

This invention relates to a screen retractor mechanism for an accordion type net screen or the like which is foldably stretchable to cover an opening in a housing structure, for example, for blinding or shading purposes or for blocking intrusion of insects through the opening.

Description of the Prior Art

For the purpose of shielding off insects or shading or blinding an opening in a housing wall, there have thus far been known in the art the screen transport mechanisms which are designed to open and close, horizontally toward and away from one side of the opening, an accordion type screen with a large number of pleats which are foldably unfoldable to stretch the screen. The accordion type screen of this sort has an advantage that it can be accommodated in a far smaller space as compared with a roll type screen which is designed to be wound on a take-up roll.

In the existing screen transport mechanism as mentioned above, the accordion screen, which is foldable along a large number of pleats in the fashion of the accordion, is fixed at its base end to a receptacle box frame which constitutes one of side frame members of a screen support frame structure, and a movable frame attached to the fore end of the screen and slidable along the screen support frame for opening and closing the screen. Due to the existence of pleats, the screen of this sort is almost in a free state, so that, even in a stretched state, it is easily put in flapping or wavering motions under the influence of winds or other external forces. In order to prevent such flapping movements and to stabilize the posture of the screen, it becomes necessary to thread a suitable number of tension cords through the screen and to maintain the tension cords constantly in a predetermined degree of tautness between the movable frame and receptacle frame.

In the case of an accordion screen, which is arranged to be closed or opened through operation of the above-mentioned movable frame, for preventing the flapping movements of the screen in the winds and to facilitate the operation of the movable frame, it is advantageous from the standpoint of cost to provide a pendant weight which is connected to base ends of the tension cords and suspended vertically movably within the receptacle box frame to maintain the tension cords in a taut state.

It is also conceivable to employ a spring as a means for keeping the tautness of the tension cords, which however is very likely to undergo deteriorations in tensile force when used repeatedly over a long period of time and needs to be of an extremely large length to make the tensile strength uniform under all conditions including the stretched state as well as the folded state of the screen, despite a substantial increase in cost.

In the above-described retractor construction using a pendant weight on the tension cords, as soon as a latch member on the movable frame is released from a latch lock member on an opposite side frame, the movable frame is automatically driven in the screen opening direction to retract the screen into the receptacle frame by the action of the pendant weight which is connected to the base ends of the respective tension cords. When the screen is in the stretched or closed state, the tautness of the tension cords is maintained by the pendant weight to ensure that the screen retain its posture in a stabilized state almost free of flapping motions which would otherwise be caused in a marked degree under the influence of winds or the like.

In case a pendant weight is used for suppressing to a minimum the waving motions of the screen as caused by winds or the like, it is necessary for the pendant weight to be heavy enough for applying high tension to the tension cords. However, if the pendant weight is too heavy, it is very likely for the movable frame to collide violently against the receptacle box frame when the latch member is released to open the screen automatically. The collision makes surprisingly large noises, and the impacts of the collision might cause serious damages to the retractor.

Therefore, while considering the use of a pendant weight of a relatively large weight, it is necessary to provide measures which will prevent the movable frame from hitting violently against the receptacle box frame at the time of opening the screen.

SUMMARY OF THE INVENTION

It is an object of the present invention to provide a screen retractor mechanism for opening to one side a screen with a large number of flexibly unfoldable pleats in the fashion of an accordion, the screen retractor employing a pendant weight to apply a biasing force in the screen opening direction to a movable frame at the fore end of the screen by way of tension cords threaded through the screen, in combination with a resistant means adapted to apply a resistive force to descending movements of the pendant weight at least in a final stage of each screen opening stroke to produce an effect as if the pendant weight were lightened in that stage, thereby preventing the movable frame from violently colliding against a receptacle box frame at the end of the screen opening stroke.

It is another object of the present invention to provide a screen retractor mechanism which is arranged to suppress flapping movements of the screen as caused by winds when the screen is in stretched state, by applying tensile force to the tension cords to a sufficient degree by the use of the gravity of the pendant weight, if necessary accompanied by application of a resistive force to the movements of the pendant weight to produce an effect as if an additional weight were put on the pendant weight.

It is still another object of the present invention to provide a screen retractor mechanism which is more immune to timewise deteriorations in tensile force of the tension cords as compared with a screen retractor relying on a spring alone, and which permits easier maintenance and troubleshooting, in addition to an advantage that the resistive force acting on the pendant weight can be varied at an arbitrary point in the opening and closing strokes of the screen to facilitate the adjustments of the tensile force acting on the tension cords.

It is a further object of the present invention to provide a screen retractor mechanism which employs the tension cords in combination with restraining cords, which will be described hereinlater, to stabilize the posture of the movable frame attached to the fore end of an accordion type stretchable screen.

It is another object of the present invention to provide a screen retractor mechanism which ensures improved performances in automatic screen opening operations while retaining the stability of the movable frame in manual screen closing operations.

It is still another object of the present invention to provide a screen retractor mechanism which is simple in construction and low in cost.

According to the present invention, the above-stated objectives are achieved by a screen retractor mechanism basically including an accordion type flexibly stretchable screen having a large number of unfoldably foldable pleats in the fashion of an accordion, the accordion screen having the base end thereof fixedly connected to a receptacle box frame constituting one of side frame members of a screen support frame structure, and a movable frame attached to the fore end of the screen slidably along the screen support frame structure for opening and closing the accordion screen, characterized in that the screen retractor mechanism further includes a plural number of tension cords threaded through said screen and each having one end thereof fixedly connected to the movable frame and the other end led into the receptacle box frame via a turn-guide member; a pendant weight connected to the other ends of the tension cords to hang down within the receptacle box frame and constantly applying a biasing force to the movable frame in a screen opening direction; and a resistant means adapted to apply a resistive force at least against descending movement of the pendant weight as soon as the pendant weight reaches a certain lowered position close to a lowest stop position in each screen opening stroke.

The above-mentioned resistant means which applies a resistive force against descending movements of the pendant weight may be constituted by a buffer which is arranged to cushion the stopping motion of the pendant weight at a lowered position, or by a frictional impedient member which is arranged to apply a frictional resistance to descending movements of the pendant weight by frictional contact therewith.

Further, the above-mentioned buffer means for cushioning the stopping motion of the pendant weight may be constituted by a spring and/or a resilient material which is arranged to apply a biasing force to the pendant weight in the stopping direction at a lowered position close to the lowest stop position of the screen closing stroke. Alternatively, the pendant weight may be arranged to reciprocate up and down within a guide cylinder which is located in the receptacle box frame, and which is provided with an air leak gap in a pressure chamber to relieve the air pressure in the pressure chamber where a higher air pressure is built up as the pendant weight approaches the lowest stop position.

On the other hand, the frictional impedient member which applies a frictional resistance to the movement of the pendant weight may be constituted by a resilient friction member which is attached to the pendant weight for sliding contact with inner surfaces of a guide cylinder in the receptacle box frame. More specifically, the frictional impedient member may be in the form of an O-ring which is fitted on the pendant weight, or in the form of a resilient friction member which has directional characteristics, namely, which has a small resistance in the ascending direction of the pendant weight but has a large resistance in the descending direction.

Further, the frictional impedient member may be constituted by a resilient friction member which is attached on the inner surface of a guide cylinder in the receptacle frame for sliding contact with the pendant weight.

The frictional impedient means which resists the pendant weight movement in this manner may be located in such a way as to act on the pendant weight only when the weight reaches a point close to its lowest stop position, thereby preventing the movable frame from colliding violently against the receptacle frame, or may be arranged to apply a resistance to the tension cords even when the screen is in stretched state, thereby effectively suppressing flapping motions of the screen as caused by winds.

Moreover, the above-described screen retractor mechanism may further comprise a parallel displacement mechanism which restricts the posture of the movable frame for stabilized operation, in association with a plural number of tension cords each having one end thereof fixed to the movable frame and the other end connected to the pendant weight, the parallel displacement mechanism including restraining cords connected to the tension cords, the connected restraining cords each having one end thereof fixed to the movable frame and the other end fixed to another portion of the movable frame after being folded around a turn-guide member on one side frame of a screen frame and led through an upper or lower frame to the opposite side of the screen support frame in the direction of movement of the movable frame.

With the screen retractor mechanism of the above-construction, upon releasing the latch member, the screen in the stretched position is automatically opened by the biasing force of the pendant weight acting on the movable frame through the tension cords, and retracted into the receptacle box frame in a folded state.

In this instance, the descending action of the pendant weight, which exerts a biasing force on the movable frame in the screen opening direction, is met by a resistive force which functions to produce a buffering effect on the pendant weight as if the weight of the pendant weight were reduced to a substantial degree, thereby preventing the movable frame from colliding violently against the receptacle frame at the end of the screen opening stroke.

Further, in case the above-mentioned resistive force is applied while the screen is in stretched state, it contributes to suppress flapping movements of the screen in cooperation with the tensile force of the tension cords under the influence of the pendant weight, namely, producing an effect which would be attained only by a far heavier pendant weight in suppressing flapping motions of the screen to a minimum.

In addition, since the pendant weight acts at a plural number of points on the movable frame through the respective tension cords substantially uniformly in all conditions, the posture of the movable frame can always be maintained in a stable state in automatic screen retracting operations. Besides, when stretching out the screen by manually drawing out the movable frame against the action of the pendant weight, the biasing force of the pendant weight, which acts at a plural number of points on the movable frame through the tension cords, keeps the movable frame almost free of the influences of external forces which might otherwise instabilize its posture. Therefore, the operating force for the movable frame becomes uniform in terms of magnitude and direction, ensuring to operate the movable frame constantly in a relatively stable state.

Furthermore, in case the posture of the movable frame is maintained in a restrained state by means of the restraining cords which are connected to the tension cords, the movable frame can be moved in a more stabilized state.

DESCRIPTION OF PREFERRED EMBODIMENTS

Figure 1:
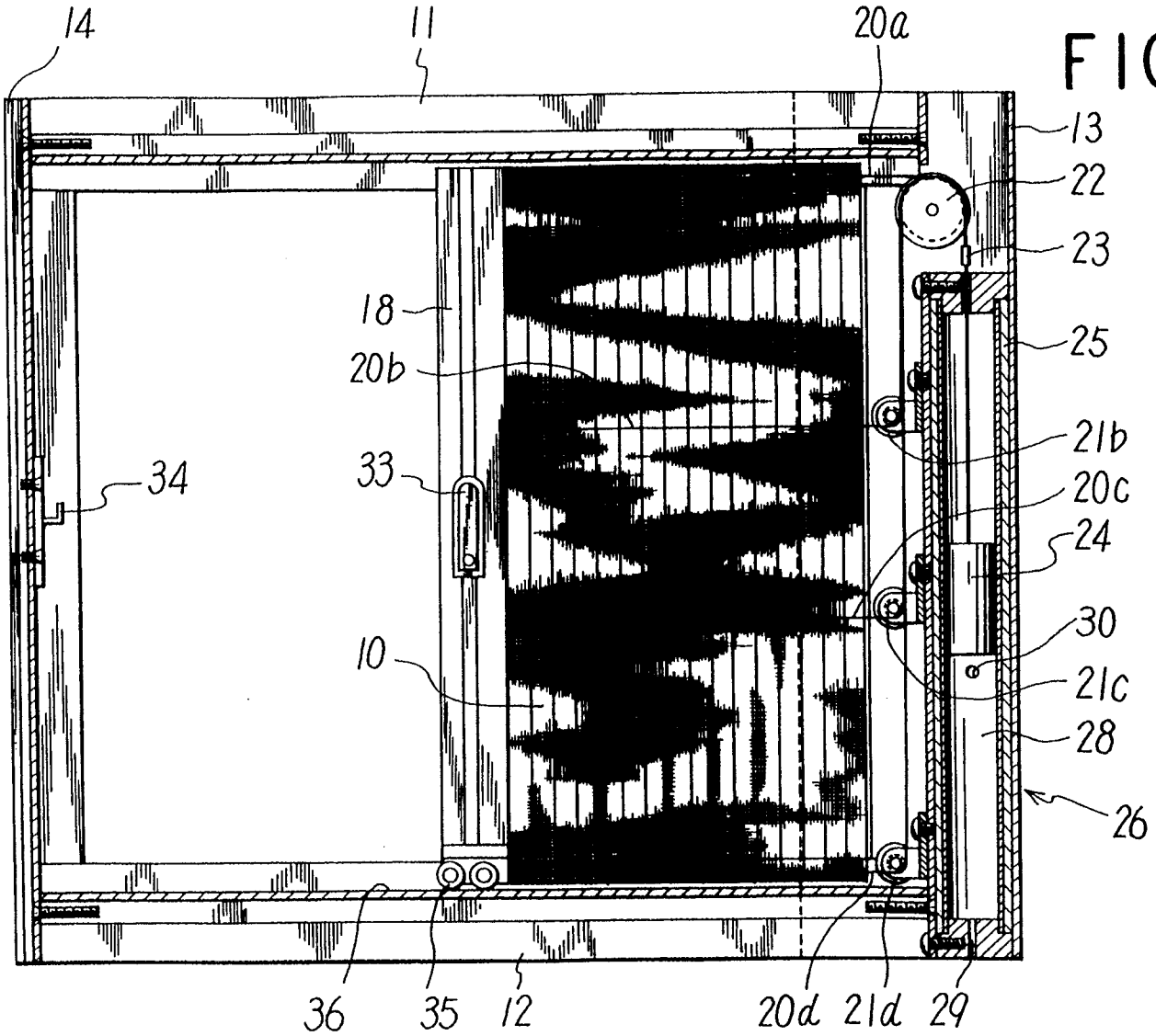
FIG. 1 is a vertically sectioned front view of an embodiment of the screen retractor mechanism according to the present invention.
Figure 2:
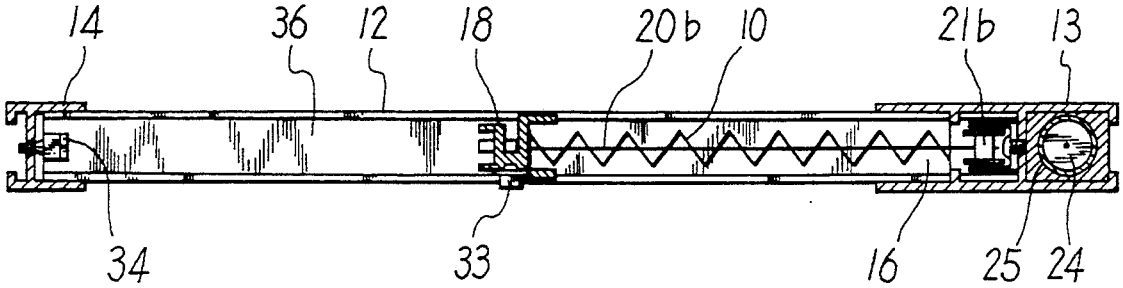
FIG. 2 is a horizontally sectioned view of the embodiment shown in FIG. 1.
Figure 3:
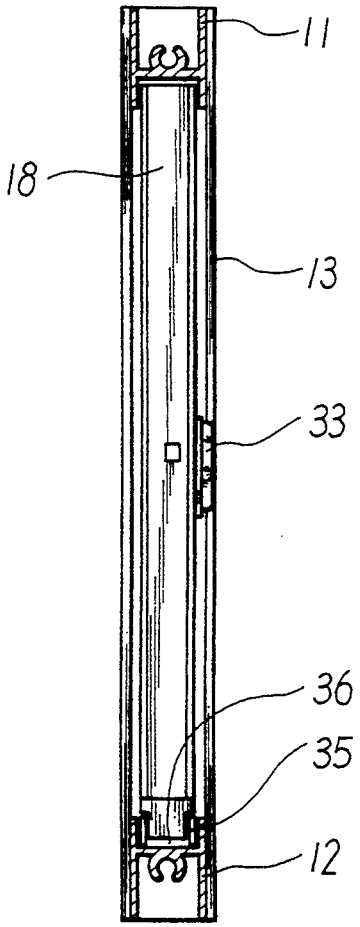
FIG. 3 is a vertically sectioned view of the same embodiment.

Referring to FIGS. 1 to 3, there is shown the construction of a first embodiment of the screen retractor mechanism according to the present invention.

The screen retractor mechanism of this embodiment is intended for installation within an opening in a housing structure for retractably covering the opening with an accordion type screen 10 which is foldably stretchable in the fashion of the accordion. The screen 10 is formed of insect-blocking net, shading net or sheet, blinding net or sheet or other suitable material depending upon the purpose of use. As seen in FIG. 2, the screen 10 is of the so-called accordion type with a large number of pleats where it is unfoldably folded alternately in the opposite directions. The screen 10 is foldably and stretchably retained in a screen support frame structure which is formed by joining together upper and lower frame members 11 and 12, a screen receptacle box frame 13 serving as one of side frame members of the frame structure, and the other side frame member 14. The screen support frame is fixed to a fitting frame which is set around the opening in the housing structure. The screen support frame is formed of aluminum or a synthetic resin material.

The receptacle box frame 13, which constitutes one side frame member of the above-described screen support frame, is provided with a receptacle box portion 16 in the form of a U-shaped channel, as shown in FIG. 2, for accommodating the screen 10 which has been folded in a direction away from the other side frame member 14. The accordion type foldably stretchable screen 10 is fixed at its base end to an inner bottom portion of the screen receptacle box 16. Attached to the fore end of the screen 10 is a movable frame 18 which is slidable along the upper and lower frame members 11 and 12. The movable frame 18 is so shaped and dimensioned as to be able to serve as a lid for closing the receptacle box frame 13 after the screen 10 has been opened and completely folded into the receptacle box frame 13.

As shown particularly in FIG. 1, a plural number tension cords 20*a* to 20*d* are threaded horizontally through the zigzag folds in the screen 10 at uniformly spaced positions, each of the tension cords 20*a* to 20*d* having one end thereof fixedly connected to the movable frame 18. Except the uppermost tension cord 20*a*, the tension cords 20*b* to 20*d* are respectively folded around a turn-guide members 21*b* to 21*d* which are mounted on the receptacle box frame 13 and led to the upper end of the receptacle box frame 13 to join the uppermost tension cord 20*a*. These tension cords are passed around a turn-guide member 22 at the upper end of the receptacle frame 13 and bundled together by a binder ring 23 to hang down together within the receptacle frame 13. The lower ends of the tension cords are fixedly connected to a pendant weight 24.

Accordingly, the movable frame 18 is constantly applied with a biasing force in the screen opening direction by means of the pendant weight 24, which at the same time maintains tautness of the tension cords 20*a* to 20*d* to stabilize the posture of the screen 10 in such a way as to suppress to a minimum the flapping motions of the screen 10 as caused by winds.

A guide cylinder 25 is located in the receptacle frame member 13 to guide the upward and downward movements of the pendant weight 24, the guide cylinder 25 forming a buffer means 26 which applies a resistive force against the descending motion of the pendant weight at a lowered position close to the lowest stop position of the screen opening stroke.

More specifically, as shown in FIG. 1, the above-mentioned buffer means 26 is constituted by the guide cylinder 25 which receives the pendant weight 24 as a piston, and which defines a pressure chamber 28 under the pendant weight to apply thereto a resistive force as soon as it reaches a position close to the lowest stop position of the screen opening stroke. Namely, as the pendant weight 24 approaches the lowest stop position of the opening stroke, the air pressure in the pressure chamber 28 is elevated and at the same time leaked through an air leak gap 29 to provide suitable air cushion for the descending pendant weight. The guide cylinder 25 is further provided with a vent hole 30 which cancels the air-cushioning effect when the pistonic pendant weight 24 is in an upper position in the guide cylinder 25. Accordingly, the initial effective position of the air cushion can be adjusted by changing the height of the vent hole 30 from the bottom end of the guide cylinder. The above-mentioned air leak gap 29 is not necessarily required to be in the form of a hole as shown in the drawings. For example, it may be substituted by a clearance between the pendant weight 24 and the guide cylinder 25 if desired.

Further, in order to retain the movable frame 18 in closed position, latch lock members 33 and 34 are provided on the movable frame 18 and the side frame member 14. Besides, the movable frame 18 is provided with roller wheels 35 at its lower end, the wheels 35 being designed to run on and along a guide surface 36 on the lower frame member 12 to ensure light sliding movements of the movable frame 18.

With the screen retractor mechanism of the above-described construction, the pendant weight 24 constantly exerts a biasing force in the screen opening direction, so that, upon releasing the lock members 33 and 34, the screen 10 in the closed position is automatically opened and folded into the receptacle frame 13 under the influence of the biasing force of the pendant weight acting on the movable frame 18 through the tension cords 20*a* to 20*d*. In this instance, the biasing force of the pendant weight acts constantly and uniformly at a plural number of points on the movable frame 18 through the tension cords 20*a* to 20*d* to open the movable frame automatically in a stable state.

On the other hand, for stretching the screen 10 into the closed position, the movable frame 18 is manually slided against the biasing force of the pendant weight 24. On such occasions, the biasing force of the pendant weight 24 contributes to hold the movable frame 18 against external forces which might otherwise instabilize the posture of the movable frame 18, and thus to operate the movable frame constantly in a relatively stable state with a uniform operating force in magnitude and direction.

The buffer means 26, which functions to slow down the descending movement of the pendant weight 24 as it approaches the lower stop position, makes it possible to produce a buffering effect on the movable frame 18 in the automatic opening operation by simple means as if the pendant weight were substantially reduced in weight, thereby relieving the movable frame of the impacts of violent stoppage at the end of the opening stroke to prevent large noises and possible damages.

Figure 4:
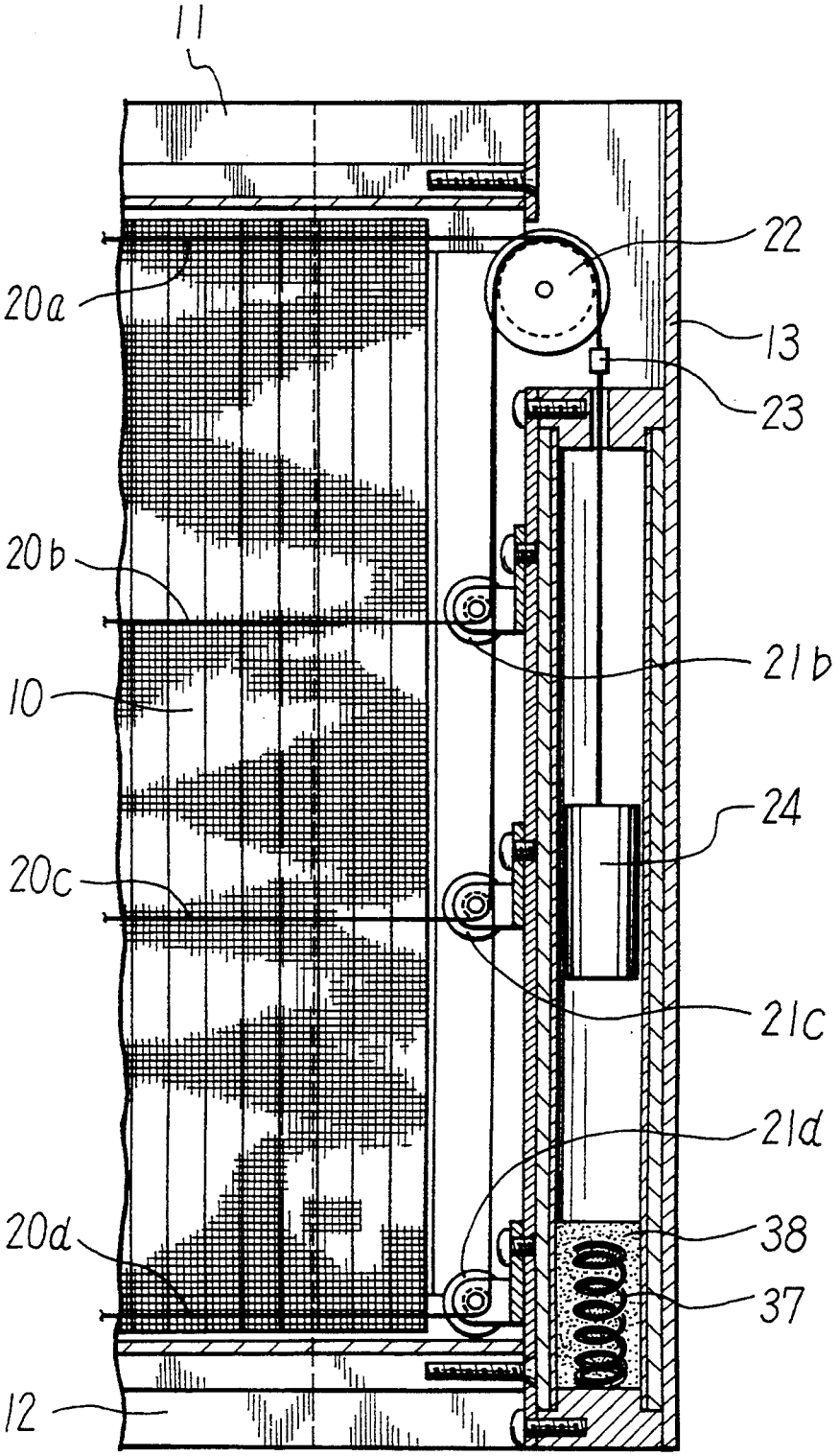
FIG. 4 is a vertically sectioned fragmentary front view of a receptacle box frame in another embodiment of the invention.

In the second embodiment illustrated in FIG. 4, the buffer means 26 is constituted by a spring 37 and a sponge-like resilient member 38, which are arranged to apply a counter biasing force to the descending pendant weight as soon as it reaches a position close to its lowest stop position. These spring and resilient members 37 and 38, however, are not necessarily required to be provided in combination, and either the spring 37 or resilient member 38 may be independently used as a buffer means if desired. In this particular embodiment, the pendant weight 24 is not adapted to act as a piston as in the embodiment of FIG. 1. In other respects, the embodiment of FIG. 4 is arranged substantially in the same manner as in the first embodiment of FIG. 1, so that common component parts are designated by common reference numerals or characters and their explanations are omitted to avoid unnecessary repetitions.

Figure 5:
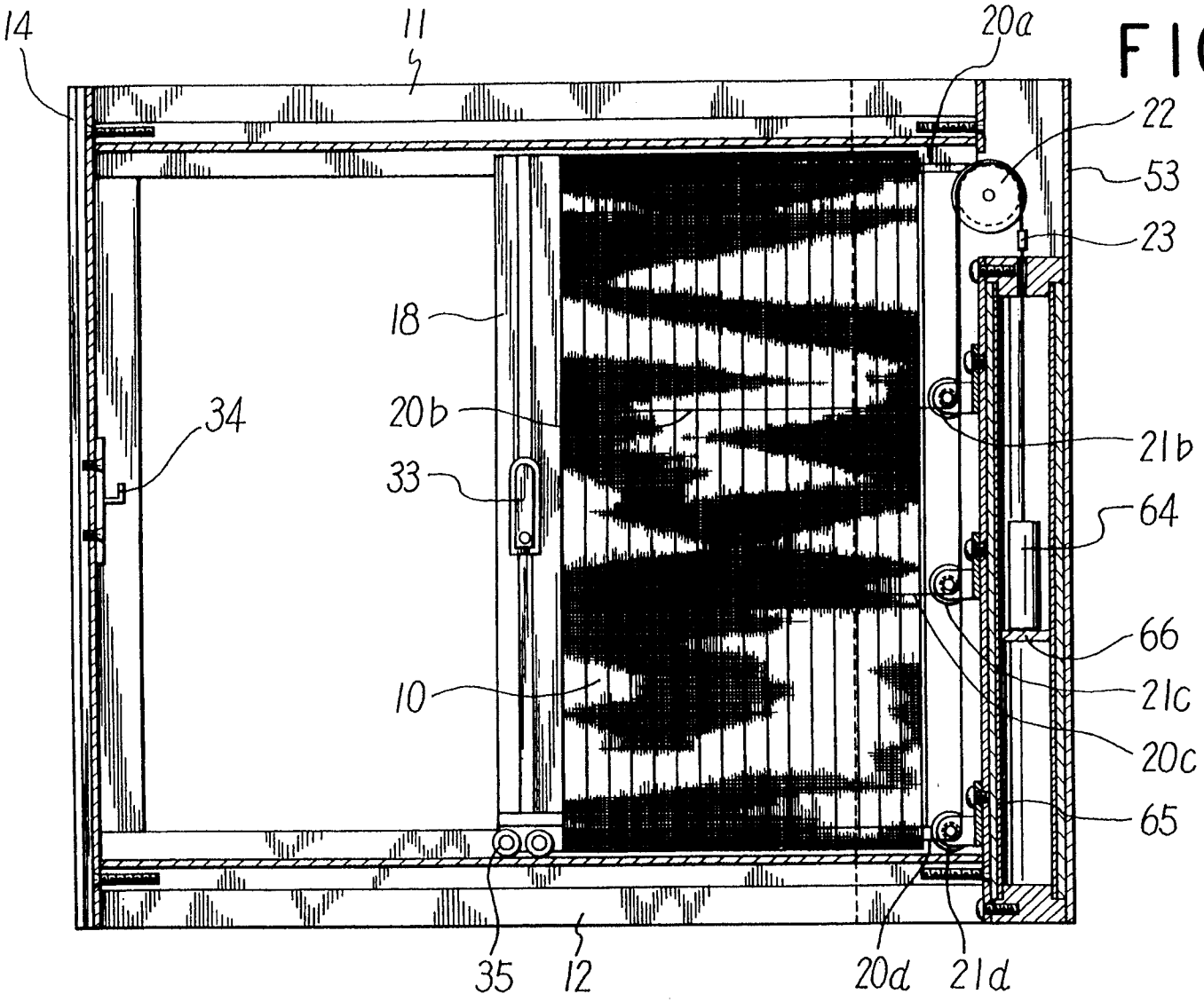
FIG. 5 is a vertically sectioned front view of another embodiment of the screen retractor mechanism according to the present invention.

In the third embodiment illustrated in FIG. 5, most of the retractor components including the screen frame, except the receptacle box frame 53, the movable frame 18 and the screen 10 are arranged substantially in the same manner as in the first embodiment, so that only modified parts are explained in the following description, without repeating explanations of the common component parts which are designated by common reference numerals or characters.

In the third embodiment, a guide cylinder 65 is located within the receptacle frame 53 to guide upward and downward movements of a pendant weight 64. The pendant weight 64 is provided with a frictional impedient member 66 to be held in contact with the inner surface of the guide cylinder 65 thereby to apply frictional brakes to the movement of the pendant weight 64. The frictional impedient member 66 may be formed of an arbitrary frictional material such as rubber, cloth, wood, metal or the like. In the case of the embodiment shown in FIG. 5, the frictional impedient member 66 is constituted by a resilient friction material in the form of a plate-like rubber strip which is attached to the lower end face of the pendant weight 64 and which has its peripheral portions in sliding contact with the inner surface of the guide cylinder 65.

The resistive force by the frictional contact between the frictional impedient member 66 and the guide cylinder 65 may be applied to the pendant weight 64 not only in the final stage of the screen opening stroke but also in other arbitrary stages. Arrangements may be made to increase the frictional resistance especially when the screen 10 is in the stretched state (when the pendant weight 64 is in the upper lifted position), for the purpose of suppressing flapping motions of the stretched screen under the influence of winds or the like. For this purpose, the frictional resistance of the frictional impedient member 66 can be partially varied along the length of the guide cylinder 65, by broadening the inside diameter of the guide cylinder at a position where a smaller frictional resistance is desirable or by treating the inner surface of the guide cylinder or adhering a sheet with a greater frictional resistance on the inner surface of the guide cylinder at a position where a greater frictional resistance is desirable.

In this third embodiment, which is arranged to apply a resistance against the movements of the pendant weight 64 by frictional contact between the guide cylinder 65 and the frictional impedient member 66, the pendant weight 64 may be adapted to function as a piston forming a pressure chamber in the lower portion of the guide cylinder 65 to provide an air cushioning mechanism in the same manner as in the first embodiment of FIG. 1. The same applies the embodiments described below with reference to FIGS. 6 to 8.

Figure 6:
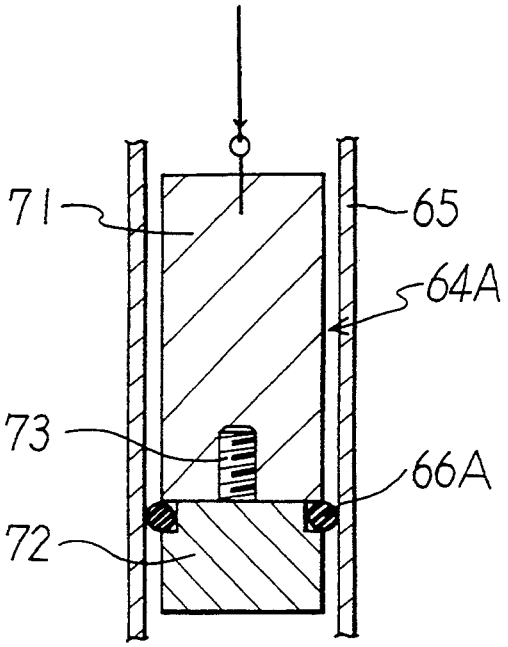
FIGS. 6 to 8 are vertically sectioned fragmentary front views of frictional impedient members of alternative constructions each suitable for use in association with the pendant weight of FIG. 5.

Namely, there may be employed an arrangement in which a pendant weight 64A having a ring-like frictional impedient member 66A is reciprocally fitted in the guide cylinder 65, as shown in FIG. 6, with the frictional impedient member 66A in sliding contact with the inner surface of the guide cylinder 65. The frictional impedient member 66A is in the form of an O-ring of resilient material which is fitted on the pendant weight and fixed in position by means of an O-ring setting member 72 of a synthetic resin material. The O-ring setting member 72 is provided with a screw portion 73 which is threaded into a tapped hole in the lower end face of the pendant weight of metal or other heavy material in such a manner as to grip the O-ring therebetween. This arrangement is advantageous in that a frictional buffer mechanism can be provided at an extremely low cost.

Figure 7:
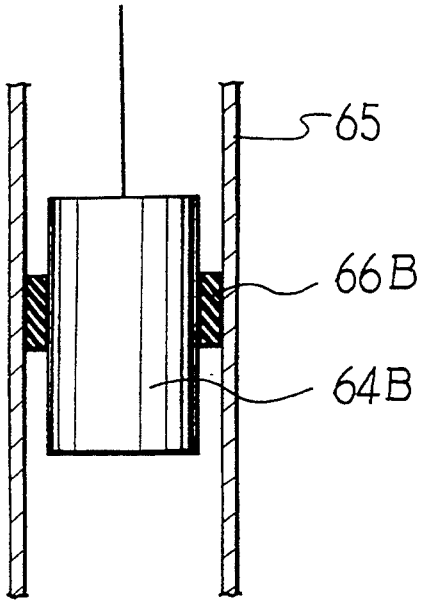
Figure 8:
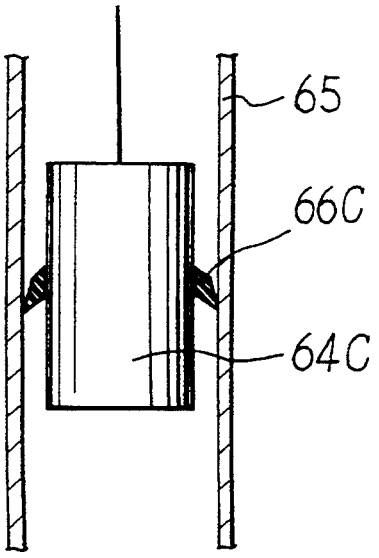

Illustrated in FIG. 7 is a modification in which a band of frictional resilient material is fitted around the circumference of a pendant weight 64B of a heavy material, in sliding contact with the inner surface of the guide cylinder 65. Further, in another modification shown in FIG. 8, a frictional impedient member 66C is mounted on a pendant weight 64C with a directionability in resistance, in such a manner as to exert a greater resistance in the descending direction than in the ascending direction of the pendant weight 64C. Namely, the outer end of the frictional impedient member 66C of resilient material is projected downwardly outward for sliding contact with the inner surface of the guide cylinder 65. In this case, the frictional impedient member 66C has a greater frictional resistance in the descending direction than in the ascending direction of the pendant weight. Therefore, it can produce buffering effects in a final stage of the screen opening stroke to prevent the movable frame 18 from colliding violently against the receptacle frame 53, while, in the manual screen closing operation by way of the movable frame, permitting to draw the movable frame relatively lightly with less frictional resistance. Each of the frictional impedient members 66A, 66B and 66C may be mounted in an arbitrary position on the circumference of the pendant weight.

Figure 9:
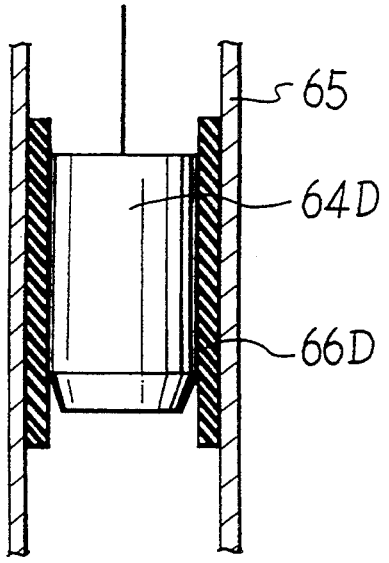
FIG. 9 is a vertically sectioned fragmentary view of an embodiment having a frictional impedient member mounted on an inner surface of a guide cylinder in a receptacle box frame.

FIG. 9 shows another modification which has a frictional impedient member 66D of resilient material bonded on the inner surface of the guide cylinder 65 for sliding contact with the descending or ascending pendant weight 64D. In case the frictional impedient member 66D is provided on the part of the guide cylinder 65, it becomes possible to apply frictional brakes to descending or ascending movements of the pendant weight at arbitrary points of the screen opening and closing strokes by bonding the frictional impedient member partially on the corresponding upper or lower portions of the guide cylinder.

In the screen retractor of the above-described third embodiment, similarly the screen 10 is automatically opened by the biasing force of the pendant weight acting on the movable frame 18, and at such a time a frictional impedient member on a lower portion of the guide cylinder can apply frictional resistance to the descending movement of the pendant weight to produce buffering effects on the movable frame 18 which is being drawn toward the receptacle frame 53, preventing violent collision of these components at the end of the screen opening stroke.

Further, in case the frictional impedient member is so located as to apply the frictional resistance even when the screen is in stretched state, it contributes to suppress flapping motions of the screen in cooperation with the tensile force of the tension cords 20*a* to 20*d*, producing the same effects as would be attained by a far heavier pendant weight in suppressing the waving motions of the screen in the winds or caused by other external forces.

When stretching out the screen 10 by manually sliding the movable frame 18 against the biasing action of the pendant weight and the frictional force, these biasing force and frictional force contribute to preclude the influences of external forces which would instabilize the posture of the screen and to make uniform the operating force in magnitude and direction, permitting to operate the movable frame 18 constantly in a relatively stable state.

Since the posture of the movable frame 18 on the screen 10 is not restrained by the screen 10 itself, it is desirable to provide a parallel displacement mechanism which maintains the movable frame in a predetermined posture. In this regard, there may be provided a parallel displacement mechanism as schematically shown in FIG. 10, commonly using part of the above-described screen retractor mechanism to retrain the posture of the movable frame.

Figure 10:
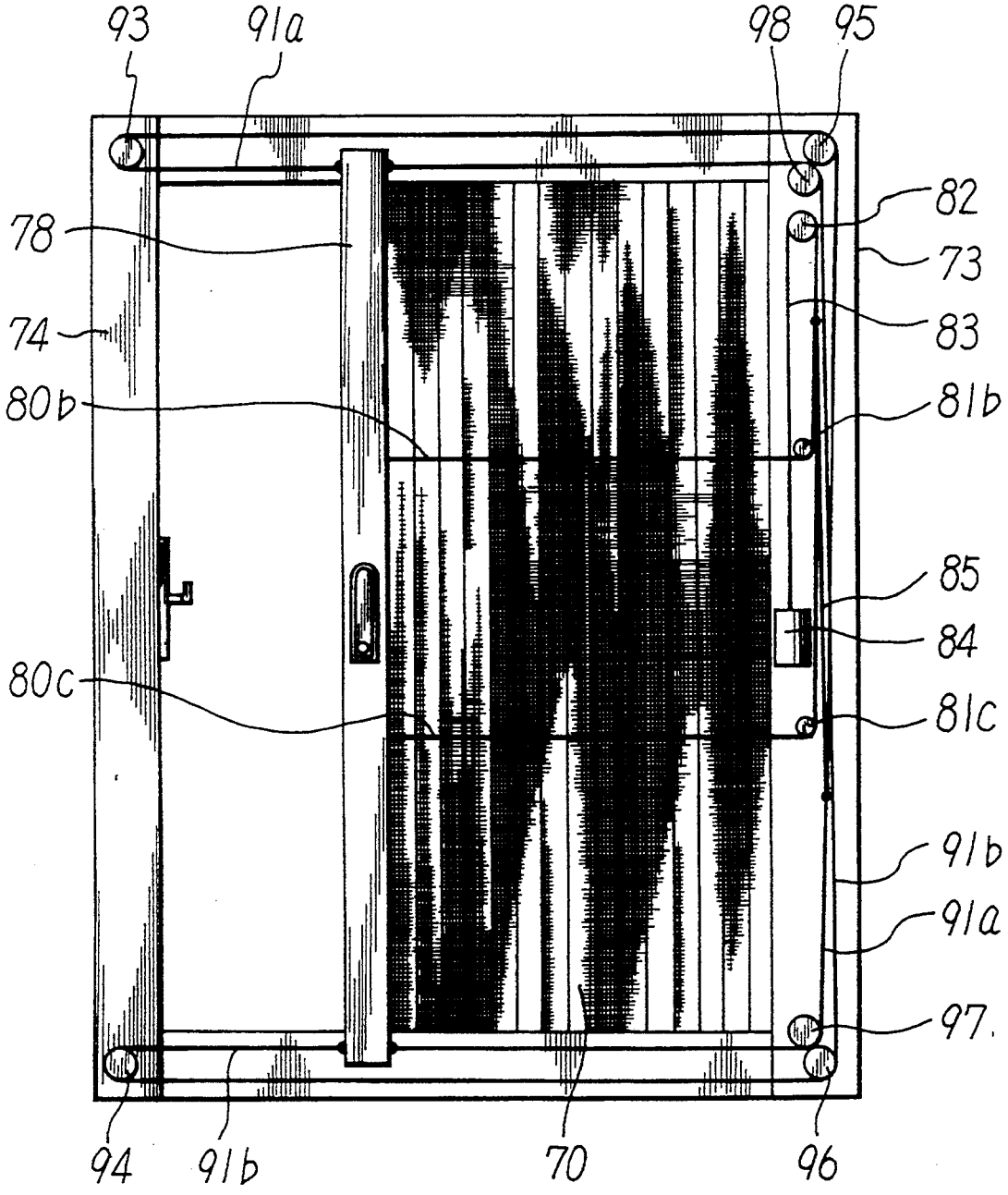
FIG. 10 is a schematic front view of an example of parallel displacement mechanism to be incorporated into the foregoing embodiments of the invention.

The parallel displacement mechanism shown in FIG. 10 employs restraining cords 91*a* and 91*b* which are fixedly connected at one end to the upper and lower ends of a movable frame 78 and which are wrapped around turn-guide members 93 and 94 at the opposite ends of a side frame 74 on the remote side away from the receptacle frame 73 to reverse their directions and then wrapped around turn-guide members 95 and 96 on the upper and lower ends of the receptacle frame 73. The restraining cords 91*a* and 91*b* folded at right angles around the turn-guide members 95 and 96 are then folded around turn-guide members 97 and 98, which are provided on the lower and upper ends of the receptacle frame opposingly to the turn-guide members 95 and 96, and fixed at the other end to lower and upper portions of the movable frame 78, respectively. Accordingly, the posture of the movable frame 78 is restrained by these restraining cords 91*a* and 91*b* in such a manner as to maintain parallel relations with the receptacle frame 73 and side frame 74 especially when moved to open or close the screen.

Further, in the same manner as in the foregoing embodiments, one end of each of tension cords 80*b* and 80*c* is connected to the movable frame 78, the tension cords 80*b* and 80*c* being threaded through the screen 70 and folded around turn-guide members 81*b* and 81*c* on the receptacle frame 73 and around a turn-guide member 82 on an upper portion of the receptacle frame 73. A pendant weight 84 is attached to the other ends of the tension cords 83, which are hung down in the receptacle box frame 73, to apply to the movable frame a biasing force in the screen opening direction through the tension cords 83. In this case, through a connecting cord 85, the tension cords 83 with the pendant weight 84 are connected to the afore-mentioned restraining cords 91*a* which hold the posture of the movable frame 78 in a restrained state. In a case where the restraining cord 91*a* is folded around the turn-guide member 97 on a lower portion of the receptacle frame 73 and then connected to the movable frame 78, and in a case where the restraining cord 91*b* is folded around the turn-guide member 98 on an upper portion of the receptacle frame 73 and then connected to the movable frame 78, the restraining cord 91*a* or 91*b* may be threaded through the screen 70 to produce the same effects as by the tension cords 20*a* and 20*d* of the first embodiment.

Although not shown in the drawings, of course the resistive impedient means in each of the foregoing embodiments is applicable to the pendant weight 84.

Moreover, the turn-guide members in the foregoing embodiments can be constituted by rotatable pulleys or fixed guide pieces of a synthetic resin material with a small frictional resistance against the tension cords.

What is claimed is:

1. A screen retractor mechanism including an accordion type flexibly stretchable screen having a large number of unfoldably foldable pleats in the fashion of an accordion, said accordion screen having the base end thereof fixedly connected to a receptacle box frame constituting one of side frame members of a screen support frame structure, and a movable frame attached to the fore end of said screen slidably along said screen support frame structure for opening and closing said accordion screen, characterized in that said screen retractor mechanism comprises:

a plural number of tension cords threaded through said screen and each having one end thereof fixedly connected to said movable frame and the other end led into said receptacle box frame via a turn-guide member;

a pendant weight connected to the other ends of said tension cords to hang down within said receptacle box frame and constantly applying a biasing force to said movable frame in a screen opening direction; and a resistant means adapted to apply a resistive force at least against descending movement of said pendant weight as soon as said pendant weight reaches a certain lowered position close to a lowest stop position in each screen opening stroke.

2. A screen retractor mechanism as defined in claim 1, wherein said resistant means for application of a resistive force against descending movements of said pendant weight is constituted by a buffer means arranged to cushion descending movements of said pendant weight at a certain lowered position.

3. A screen retractor mechanism as defined in claim 1, wherein said resistant means is constituted by a frictional impedient member located between said pendant weight and said receptacle frame to apply a frictional resistance to descending movements of said pendant weight by frictional contact therewith.

4. A screen retractor mechanism as defined in claim 2, wherein said buffer means for cushioning descending movements of said pendant weight is constituted by a spring and/or a sponge-like resilient material adapted to apply a biasing force to said pendant weight in the stopping direction at a certain lowered position thereof.

5. A screen retractor mechanism as defined in claim 2, wherein said buffer means comprises a guide cylinder located within said receptacle frame and slidably receiving said pendant weight as a piston for upward and downward reciprocating movements therein, said guide cylinder defining under said pendant weight a cushioning pressure chamber with an air leak gap to relieve the air pressure gradually built up in the pressure chamber as said pendant weight approaches the lowest stop position thereof.

6. A screen retractor mechanism as defined in claim 3, wherein said frictional impedient member is constituted by a resilient friction member attached to said pendant weight for sliding contact with inner surfaces of a guide cylinder in said receptacle box frame.

7. A screen retractor mechanism as defined in claim 6, wherein said frictional impedient member is in the form of an O-ring which is fitted on said pendant weight.

8. A screen retractor mechanism as defined in claim 6, wherein said frictional impedient member is in the form of a resilient friction member with directional characteristics, having a small resistive force in the ascending direction of said pendant weight but having a large resistive force in the descending direction.

9. A screen retractor mechanism as defined in claim 3, wherein said frictional impedient member is constituted by a resilient friction member attached on the inner surface of a guide cylinder in said receptacle frame for sliding contact with said pendant weight.

10. A screen retractor mechanism as defined in claim 1, wherein a plural number of said tension cords are threaded horizontally through said screen at uniformly spaced positions.

11. A screen retractor mechanism as defined in claim 1, further comprising a parallel displacement mechanism to restrict the posture of said movable frame for stabilized operation, in association with a plural number of tension cords each having one end thereof fixed to said movable frame and the other end connected to said pendant weight, said parallel displacement mechanism including restraining cords connected to said tension cords, the connected restraining cords each having one end thereof fixed to said movable frame and the other end fixed to another portion of said movable frame after being folded around a turn-guide member on one side frame of a screen support frame and led through an upper or lower frame member to the opposite side of said screen support frame in the direction of movement of said movable frame.

* * * * *